United States Patent [19]

Merillat

[11] 4,439,888

[45] Apr. 3, 1984

[54] SUBSTANTIALLY CONCEALED HINGE FOR DOOR WITH RECESS

[75] Inventor: Orville D. Merillat, Adrian, Mich.

[73] Assignee: Merillat Industries, Inc., Adrian, Mich.

[21] Appl. No.: 331,453

[22] Filed: Dec. 17, 1981

[51] Int. Cl.[3] ..... E05F 1/12

[52] U.S. Cl. ..... 16/286; 16/72; 16/305; 16/390; 16/391

[58] Field of Search ..... 16/50, 71, 75, 76, 243, 16/248, 286, 304, 305, 308, 387, 389, 390, 391, 392

[56] References Cited

U.S. PATENT DOCUMENTS

| | | | |
|---|---|---|---|
| 686,025 | 11/1901 | Cannon | 16/248 |
| 1,138,025 | 5/1915 | Stoll | 16/389 |
| 2,624,067 | 1/1953 | Tassell | 16/389 |
| 3,047,912 | 8/1962 | Sobolewski | 16/390 X |
| 3,177,519 | 4/1965 | Johnson, Jr. | 16/286 |
| 3,439,377 | 4/1964 | Bucholz | 16/389 |
| 3,715,778 | 2/1973 | Wilson | 16/50 X |
| 3,908,228 | 9/1975 | Newcomer | 16/286 |

FOREIGN PATENT DOCUMENTS

| | | | |
|---|---|---|---|
| 82784 | 2/1920 | Austria | 16/389 |
| 704981 | 4/1966 | Italy | 16/389 |
| 503163 | 4/1939 | United Kingdom | 16/387 |

*Primary Examiner*—Fred A. Silverberg

*Attorney, Agent, or Firm*—Allen D. Gutchess, Jr.

[57] ABSTRACT

A door and a substantially concealed hinge are provided, particularly for cabinets. The hinge is designed to be substantially hidden in a wedge-shaped recess in a hinge edge of the door. The recess can be made by a single pass of a cutting tool relative to the door or vice versa. The hinge includes a first hinge wing and a second hinge wing connected by a knuckle. The first hinge wing has a first portion extending outwardly from the knuckle in a generally radial direction and a second portion structurally integral with the first portion, extending at an angle relative to the first portion, and having openings for mounting the first hinge wing on the door frame. The second hinge wing has a third portion extending generally radially-outwardly from the knuckle at a narrow, included angle relative to the plane of the door and to the second hinge portion when the hinge is in a closed position. The second wing has a fourth portion structurally integral with the third, angular portion and extending outwardly in a plane parallel to the door and to the second portion of the first wing when the hinge is in the closed position. The fourth portion of the second wing also has openings for attaching the second wing to the inner surface of the door. The first portion of the first wing, the third portion of the second wing, and all or substantially all of the knuckle lie within the wedge-shaped recess for all positions of the door.

7 Claims, 6 Drawing Figures

SUBSTANTIALLY CONCEALED HINGE FOR DOOR WITH RECESS

This invention relates to doors and substantially concealed hinges, particularly for cabinets and the like.

Concealed and partially concealed hinges of various types are known in the art. Heretofore, such hinges have tended to be complex and expensive to produce, requiring a number of parts and/or precision machining operations. The doors and door frames have also required specially shaped recesses to accommodate portions of such hinges.

The present invention provides a substantially concealed hinge which is relatively inexpensive to produce, having few parts and requiring no special machining operations. The hinge is also designed so as to be mounted in a generally wedge-shaped recess in the hinge edge of the door, the recess being of triangular shape as viewed in a plane taken perpendicularly to the hinge edge of the door and transversely to the plane of the door.

The hinge basically includes two one-piece hinge wings having knuckle portions connected by a hinge pin, thus involving no additional parts beyond those found in simple, conventional cabinet hinges. A first wing of the hinge has a first portion extending outwardly from the knuckle and a second portion structurally integral with the first and extending at an angle to the first portion, with the second portion having means for receiving fasteners for attaching the second portion to the door frame of the cabinet. A second wing of the hinge has a third portion extending outwardly from the knuckle and forming a narrow included angle with the plane of the door frame and the second hinge portion when the hinge is in a closed position, and also with the plane of the inner surface of the door. The second wing has a fourth portion which is structurally integral with the third portion and extends outwardly therefrom parallel to the plane of the inner surface of the door frame, with the fourth portion having means for receiving fasteners for attaching the second wing to the door.

The hinge recess in the door can be formed in a single pass of the door relative to a cutting tool or vice versa. When the bottom of the wedge-shaped recess is straight, the hinge edge of the door can be passed over a circular cutting tool with the door at an angle to the direction of movement of the door relative to the cutter. When the bottom of the wedge-shaped recess is curved, the door can be moved partly over the circular cutting tool with the door being parallel to the direction of movement. The door is then retracted after being penetrated the desired amount by the cutting tool. In either case, only one pass is necessary to form the recess, whether the door is moved completely beyond the tool or into the tool and back.

It is, therefore, a principal object of the invention to provide an improved door and substantially concealed hinge.

Another object of the invention is to provide a substantially concealed hinge for doors of cabinets and the like.

Yet another object of the invention is to provide a door and a substantially concealed hinge which are of lower cost.

Still another object of the invention is to provide a substantially concealed hinge received in a door recess which can be simply and quickly formed by a circular cutting tool.

Many other objects and advantages of the invention will be apparent from the following detailed description of preferred embodiments thereof, reference being made to the accompanying drawings, in which.

Figure 1:
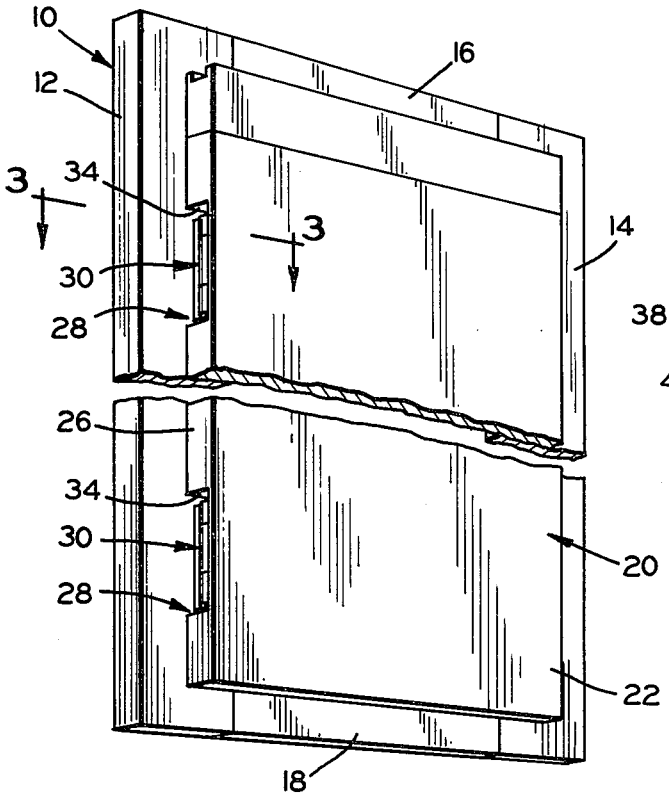
FIG. 1 is a fragmentary view in perspective of a cabinet door and door frame employing partially concealed hinges.

Referring to the drawings, and more particularly to FIG. 1, a door frame of a cabinet is indicated at 10 and includes two upright frame members 12 and 14 and upper and lower frame members 16 and 18 extending between the upright members. The frame members describe a rectangular cabinet opening covered by a cabinet door 20 embodying the invention. The door can be of many suitable designs and includes an outer surface 22 and an inner surface 24 with a square hinge edge 26 extending therebetween.

The hinge edge of the door has a wedge-shaped recess 28 for each hinge 30 to be used to pivotally mount the door 20 on the frame 10. The recess 28 is also of generally triangular shape as viewed in cross section taken perpendicular to the hinge edge 26 of the door 20 and transversely to the plane of the inner surface 24 of the door. The recess 28 includes a slanted bottom surface 32 extending at an angle to the plane of the inner surface 24 of the door, and side surfaces 34 and 36 which are parallel to one another and substantially perpendicular to the plane of the inner surface 24 of the door 20.

The recess 28 can be formed in the door 20 by making a single pass of the door 20 over a rotary, circular cutting tool, or vice versa, The inner corner of the hinge edge 26 of the door can be supported on a suitable surface above which a portion of the cutting tool extends, with the door 20 held at an angle on the supporting surface such that the resulting bottom surface 32 of the recess 28 will be parallel to the supporting surface. The door is then simply fed over and past the tool in a single pass to form the recess 28 with no further operations being necessary.

The hinge 30 basically includes a first wing 38 and a second wing 40 connected by a knuckle 42. The first wing 38 has a central knuckle portion or sleeve 44 with offsets or shoulders 46 at its edges. The wing 38 has a first portion 48 structurally integral with the sleeve 44 and extending generally radially outwardly therefrom. A second portion 50 extends at a large, substantially 90°, angle to the first portion 48, in this instance, and is structurally integral therewith. The second portion 50 is provided with means 52 in the form of elongate holes, in this instance, for receiving fasteners 53 to attach the first wing 38 to the door frame 10. The holes 52 are elongated in a horizontal direction to enable adjustment of the hinge 30 in a horizontal direction relative to the frame. The depth of the recess 28 at the hinge edge 26 preferably is at least equal to the diameter of the knuckle 42 and the length of the first portion 48.

Figure 2:
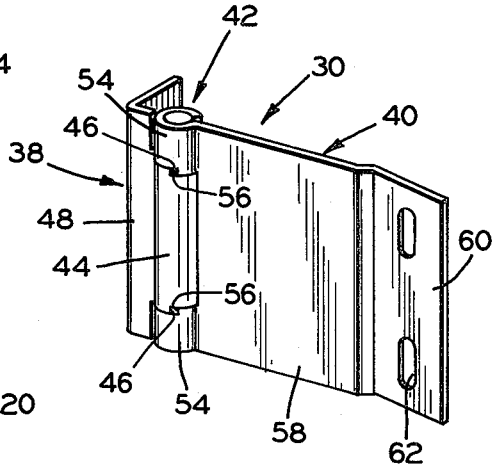
FIG. 2 is a view in perspective of one of the hinges of FIG. 1, shown in an open position.
Figure 3:
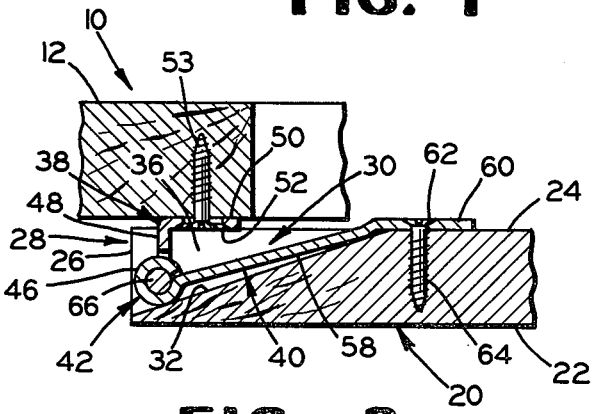
FIG. 3 is an enlarged, fragmentary view in transverse cross section taken along the line 3—3 of FIG. 1.

The second hinge wing 40 has two outer knuckle portions or sleeves 54 on each side of the sleeve 44 and which are also provided with offsets or shoulders 56. These cooperate with the shoulders 46 on the sleeve 44 to limit the extent to which the hinge 30 and the door 20 can open, the hinge 30 being shown substantially in its widest open position in FIG. 2. The wing 40 has a third hinge portion 58 structurally integral with the sleeves 54 and extending substantially radially outwardly therefrom, forming a narrow included angle with the plane of the door and specifically with the plane of the inner surface 24 of the door. The third portion 58 also forms a similar narrow included angle with the second portion 50 of the wing 38 when the hinge is in the closed position of FIG. 3 with the plane of the door parallel with the plane of the cabinet opening. The included angle can be from 10° to 35°, and preferably from 15° to 30°.

The second hinge wing 40 also has a fourth portion 60 extending outwardly from the outer edge of the third portion 58 and having means, in the form of fastener holes 62, to fasten the second hinge wing 40 to the door 20, and specifically to the inner surface 24 of the door with fasteners 64. The holes 62 are elongate in a vertical direction to enable vertical adjustment of the door 20 relative to the frame 10. The spacing of the side surfaces 34 and 36 of the recess 28 also exceeds the width of the third hinge portion 58 to enable the vertical adjustment to be possible. The included angle between the plane of the fourth portion 60 and the third portion 58 is similar to the included angle between the plane of the third portion 58 and the plane of the inner surface 24 of the door, when the hinge is fastened to the door. The fourth portion 60 is also parallel to the second portion 50 when the hinge is in its closed position.

A hinge pin 66 forms part of the knuckle 42 and pivotally connects the sleeves 44 and 54. If desired, the pin 66 can be headed, although a straight one is preferred for economical reasons.

When the hinge 30 is assembled in the recess 28 of the door 20, it lies entirely within the hinge edge 26 of the door so that none of the hinge is exposed when the door 20 is viewed directly from the front. The hinge is visible when viewed from the hinge edge side as in FIG. 1 but this is not considered detrimental from an aesthetic standpoint, in most instances.

Figure 4:
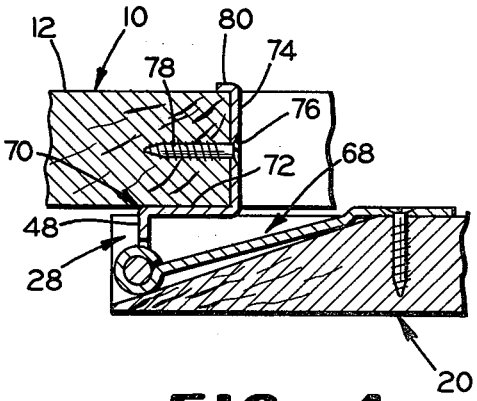
FIG. 4 is a view similar to FIG. 3 of a modified hinge.

Referring to FIG. 4, a modified hinge according to the invention is indicated at 68. The hinge 68 basically differs from the hinge 30 in that it has a modified first wing 70 having a longer second hinge portion 72 structurally integral with the first hinge portion 48, the second portion 72 extending to the edge of the door frame member 12. Means for attaching the second hinge portion 72 to the frame member 12, in this instance, includes a transverse hinge portion 74 which is perpendicular to and structurally integral with the second hinge portion 72 and has holes 76 for receiving fasteners 78 in the edge of the frame member 12, rather than in the front surface thereof. The transverse portion 74 can have a perpendicular lip 80 at its outer edge, which lip extends over the inner surface of the frame member 12 to provide greater support for the door and the hinge.

Figure 5:
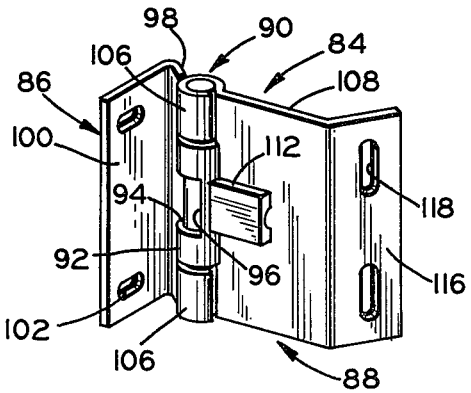
FIG. 5 is a view similar to FIGS. 3 and 4 of a modified hinge and a slightly modified hinge recess in the door.
Figure 6:
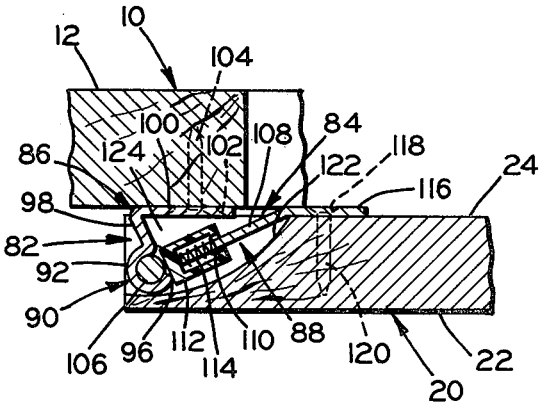
FIG. 6 is a view in perspective of the hinge of FIG. 5, shown in open position.

Referring to FIGS. 5 and 6, the door 20 has a slightly modified recess 82 receiving a modified hinge 84. The hinge 84 differs in that it has a self-closing feature, which is basically known in the art. The hinge 84 includes a first hinge wing 86 and a second hinge wing 88 connected by a knuckle 90. The first hinge wing 86 includes a central knuckle portion or sleeve 92 having a rectangular notch 94 forming a shoulder 96. The first hinge wing 86 also has a first hinge portion 98 structurally integral with the sleeve 92 and extending generally radially outwardly therefrom toward the frame member 12, but at more of an angle away from the door opening than the first portion 48. The hinge wing 86 also has a second portion 100 structurally integral with the first portion 98 and extending therefrom parallel to the face of the door frame member 12. The second hinge portion 100 also has means shown in the form of holes 102, in this instance, for receiving fasteners 104 to affix the first hinge wing 86 to the door frame member 12. However, the portion 100 is substantially longer than the second hinge portion 50.

The second hinge wing 98 has outer knuckle portions or sleeves 106 with a third hinge portion 108 structurally integral therewith and extending substantially radially therefrom. The third portion 108 is somewhat shorter than the third portion 58 of the hinge 30 and forms a wider included angle with the plane of the inner surface of the door and with the second portion 100 of the hinge wing 86 when the door is in the closed position. The third portion 108 has a rectangular notch 110 in a central portion thereof opening at the edge adjacent the sleeve 92 of the hinge portion 86. A plastic plunger or carrier 112 is located in the notch 110, having edge grooves received over longitudinal edges of the notch 110 and is longitudinally moveable toward and away from the shoulder 96 of the notch 94 of the sleeve 92. The plunger 112 is hollow and carries one or, preferably, two side-by-side springs 114 maintained in compression between the closed end of the plunger 112 and the end of the notch 110. When the door is partly closed, the plunger 112 is urged by the springs 114 against the shoulder 96 to urge the door to the closed position and even beyond the closed position, to maintain the door closed.

A fourth portion 116 of the hinge wing 88 is structurally integrally with the outer edge of the third hinge portion 108 and the plane of the portion 116 forms an angle with the portion 108 similar to the included angle between the hinge portion 108 and the plane of the inner surface 24 of the door 20. The fourth portion 116 has means in the form of elongate holes or slots 118 to receive fasteners 120 to affix the hinge wing 82 to the door. The portions 108 and 116 can be somewhat wider than the hinge portions 58 and 60 to provide greater stability in order to make up for the shorter length of the hinge portion 108.

The hinge recess 82 of FIG. 5 has a bottom surface 122 which is of arcuate configuration rather than being planar as is the surface 32. This enables more clearance to be provided between the third hinge portion 108 and the surface 122 to accommodate the lower half of the plastic plunger 114. The recess also has parallel side surfaces 124, which are spaced farther apart than the surfaces 34 and 36 of the recess 28 to accommodate the greater width of the third hinge portion 108 and to permit vertical adjustment. The recess 82 is still of generally triangular shape as taken in a plane which is perpendicular to the hinge edge 12 of the door and is transverse to the plane of the door. The depth of the recess 82 at the hinge edge also at least equals the diameter of the knuckle 90 and the length of the first portion 98.

When forming the recess 82, the inner surface 24 of the door 20 is placed on a supporting surface above which a rotary cutting tool projects with the door then moved in a path parallel to the plane of the supporting surface and the inner surface 24 of the door. The hinge edge of the door is moved into engagement with the cutting tool the desired distance and then is retracted so that the recess 82 again can be made in one pass or operation.

Where two or more of the recesses 30 and 82 are to be formed in the door, two or more of the cutting tools can be appropriately spaced so that all of the recesses can be formed in one pass or operation.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In combination, a hinge, a frame, and a door, said hinge being substantially concealed by said door and pivotally mounting said door on said frame, said hinge comprising a first hinge wing, a second hinge wing, and a knuckle, said first hinge wing comprising a first portion extending outwardly from said knuckle and a second portion extending at an angle to said first portion and substantially parallel to a surface of said frame, said second portion having means for receiving fasteners for attaching said second portion to said frame, said second wing comprising a third portion extending outwardly from said knuckle and forming a narrow included angle with the plane of the door and with the plane of said frame when said door is in a closed position, and a fourth portion extending outwardly from said third portion and being parallel to the inner surface of said door, said fourth portion having means for receiving fasteners for attaching said fourth portion to said door, said door having a recess in a hinge edge thereof in which at least a substantial portion of said knuckle, said first portion of said first hinge wing, and said third portion of said second hinge wing are located, said recess being of generally triangular shape as viewed in a plane perpendicular to the hinge edge of the door and transverse to the plane of the door, the bottom of said recess being concave and slanting in the same direction as said third portion of said second hinge wing, said third portion of said second hinge wing carrying a spring-load plunger urged toward said knuckle, said plunger having a hollow portion that straddles part of said third portion and having a coil spring inside the hollow portion, and said knuckle comprising a sleeve structurally integral with said first portion of said hinge wing and having a shoulder aligned with said plunger to urge the door toward a closed position when engaged by said plunger, said concave bottom of said recess being spaced from the plunger to allow movement of the plunger toward and away from said sleeve, said third portion forming a narrow included angle of ten to thirty-five degrees with the second portion of said first wing when the hinge is in the closed position.

2. The combination according to claim 1 characterized by the depth of said recess at the hinge edge of the door exceeding the length of the first portion of said first hinge wing.

3. The combination according to claim 2 characterized by the width of said recess exceeding the width of said third portion of said second hinge wing to enable vertical adjustment of said door relative to said hinge.

4. The combination according to claim 1 characterized by said recess having a width exceeding the width of said third portion and having a depth at the hinge edge exceeding the diameter of said knuckle and the length of said first portion.

5. The combination according to claim 1 characterized by said fourth portion being substantially perpendicular to said first portion when said door is in a closed position.

6. The combination according to claim 1 characterized by said third portion of said second hinge wing forming an included angle of fifteen degrees to thirty degrees with the plane of the door.

7. The combination according to claim 1 characterized by said fastener receiving means of said second portion of said first wing comprising a transverse portion parallel to an inner edge surface of said frame with holes therein for receiving fasteners.

* * * * *